US009604802B1

(12) United States Patent
McFarland et al.

(10) Patent No.: US 9,604,802 B1
(45) Date of Patent: Mar. 28, 2017

(54) REMOVABLE MEDIA TRAY HAVING A MEDIA RESTRAINT WITH TRANSLATING AND PIVOTING LATCHING CAMS OPERABLE WITHOUT THE USE OF PINCHING

(71) Applicant: LEXMARK INTERNATIONAL, INC., Lexington, KY (US)

(72) Inventors: Neal Douglas McFarland, Versailles, KY (US); Dustin Daniel Fichter, Versailles, KY (US); Stacey Vaughan Mitchell, Lexington, KY (US); Edward Joseph Walden, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/060,868

(22) Filed: Mar. 4, 2016

(51) Int. Cl.
*B65H 1/00* (2006.01)
*B65H 1/04* (2006.01)

(52) U.S. Cl.
CPC ..... *B65H 1/04* (2013.01); *B65H 2405/112* (2013.01); *B65H 2405/1116* (2013.01); *B65H 2405/1122* (2013.01); *B65H 2405/1134* (2013.01); *B65H 2405/1144* (2013.01); *B65H 2405/11425* (2013.01); *B65H 2405/12* (2013.01); *B65H 2405/121* (2013.01); *B65H 2511/11* (2013.01)

(58) Field of Classification Search
CPC ... B65H 1/00; B65H 1/04; B65H 9/04; B65H 9/06; B65H 2402/5151; B65H 2403/40; B65H 2405/111; B65H 2405/1116; B65H 2405/112; B65H 2405/1122; B65H 2405/1124; B65H 2405/113; B65H 2405/1134; B65H 2405/114; B65H 2405/1142; B65H 2405/11425; B65H 2405/1144; B65H 2405/12; B65H 2405/121
See application file for complete search history.

(56) References Cited

U.S. PATENT DOCUMENTS

2002/0056691 A1* 5/2002 Siegenthaler ..... B65H 31/18 211/50
2006/0222434 A1* 10/2006 Kitamura ..... B65H 1/04 400/624
2008/0251996 A1* 10/2008 Ubayashi ..... B65H 1/04 271/226
2008/0298873 A1* 12/2008 Yamagishi ..... B65H 1/266 400/624

(Continued)

*Primary Examiner* — Prasad Gokhale
(74) *Attorney, Agent, or Firm* — John Victor Pezdek

(57) ABSTRACT

A media restraint for a removable media tray and slidably operable without the use of a pinching force. The media restraint slidably positionable on a track in a removable media tray and is operable without pinching. A pair of latching cams are used to engage the media restraint to the track and have serrated portions pivotally mounted to a bottom of the media restraint. The media restraint is operable by a finger of the user applying a downward force to the media restraint allowing a rack and pinion to horizontally translate a rack portion of the pair of latching cams away from the track and pivot the serrated portions away from the track and allowing the media restraint to be moved along the track. Upon removal of the downward force, a biasing member translates the latching cams back to reengage with the track.

19 Claims, 6 Drawing Sheets

(56) References Cited

U.S. PATENT DOCUMENTS

| | | | | |
|---|---|---|---|---|
| 2013/0161898 | A1* | 6/2013 | Lee | B65H 1/266<br>271/145 |
| 2015/0274449 | A1* | 10/2015 | Fukunaga | B65H 9/08<br>271/241 |

* cited by examiner

REMOVABLE MEDIA TRAY HAVING A MEDIA RESTRAINT WITH TRANSLATING AND PIVOTING LATCHING CAMS OPERABLE WITHOUT THE USE OF PINCHING

CROSS REFERENCES TO RELATED APPLICATIONS

The present disclosure is related to U.S. patent application Ser. No. 15/060,860 entitled "REMOVABLE MEDIA TRAY HAVING A MEDIA RESTRAINT WITH LATCHING PLUNGER OPERABLE WITHOUT THE USE OF PINCHING" filed Mar. 4, 2016; and U.S. patent application Ser. No. 15/060,878 entitled "REMOVABLE MEDIA TRAY HAVING A MEDIA RESTRAINT WITH PIVOTING LATCHING CAM OPERABLE WITHOUT THE USE OF PINCHING" filed Mar. 4, 2016, each assigned to the assignee of the present disclosure.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media input feed systems for an imaging device having a removable media tray with an adjustable media restraint.

Description of the Related Art

In 1998, Congress amended the Rehabilitation Act of 1973 (29 U.S.C. §794 (d)) to require Federal agencies to make their electronic and information technology accessible to people with disabilities. Section 508 of the Rehabilitation Act applies to all federal agencies when they develop, procure, maintain, or use electronic and information technology. Under Section 508, federal agencies must give disabled employees and members of the public access to information that is comparable to access available to others. These provisions apply to operable controls which are defined as components of a product that require physical contact for normal operation. Operable controls include, but are not limited to, media restraints. Operable controls are to be operable with one hand and not require tight grasping, pinching, or twisting of the wrist. Thus, under these requirements, the media restraint needs to be operable without the use of a pinching force.

Media restraints in removable media trays are typically provided along a bottom and side edge of a media area within the removable media tray for holding the media in place for feeding into an imaging device. The media restraints are moveable along tracks in the removable media tray to accommodate different media sizes. These media restraints are operated by a user pinching an actuation member or lever to release the media restraint from engagement with the track, and, while still pinching the actuation member or lever, moving the media restraints to a new position in the removable media tray.

It would be advantageous to have a media restraint that can be operated without the use of a pinching force. It would be further advantageous, that such a media restraint would also be moveable using a single finger.

SUMMARY OF THE INVENTION

Disclosed is a removable media tray having a media restraint that is operable without the use of a pinching force. The removable media tray comprises a bottom surface for holding media to be fed to the imaging device, a track having a plurality of teeth along a length of the track and positioned on the bottom surface, and, a media restraint slidably engageable with the track. The media restraint includes a bottom plate having a first opening therethrough, a front plate and a rear plate each depending from the bottom plate, and, a latching mechanism. Included in the latching mechanism are a first and a second pinion gear rotatably attached to one of the front and rear plates a predetermined distance from the bottom plate, an actuator, first and second latching cams and a biasing member. The actuator is slidably received between the front and rear plates and has a first position adjacent the top plate. A button depending from an upper end of the actuator and is aligned with the second opening. The actuator further has a first and a second rack portion engaged with the first and second pinion gears, respectively. The first and the second latching cams each have a serrated portion for engaging with the track and a rack portion engaging with the first and second pinion gears, respectively. The serrated portions have their ends pivotally mounted to the bottom plate. The first and second latching cams have respective first positions being engaged with the track when the actuator is in its first position. The biasing member biases the actuator and the first and the second latching cams in their respective first positions;

Upon application of a user-supplied downwardly directed force to the button, the actuator moves from its first position and translates downwardly with the first and second rack portions rotating the first and second pinion gears, respectively. This action horizontally separates and translates the first and second latching cams away from their respective first positions and pivots the latch portions thereof away from the track allowing the media restraint to be translated along the track, and, further wherein, when the downwardly directed force is removed, the biasing member returns the actuator and the first and second latching cams to their respective first positions.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 3A shows an engaged position and FIG. 3B shows an actuated or disengaged position for the media restraint.

FIG. 4A illustrates the media restraint in its first or engaged position and FIG. 4B illustrates the media restraint in an actuated or disengaged position.

FIG. 5A illustrates the media restraint in its first or engaged position and FIG. 5B illustrates the media restraint in an actuated or disengaged position.

FIG. 6A shows the media restraint in an engaged position and FIG. 6B shows the media restraint in an actuated or disengaged position.

DETAILED DESCRIPTION

Figure 1:
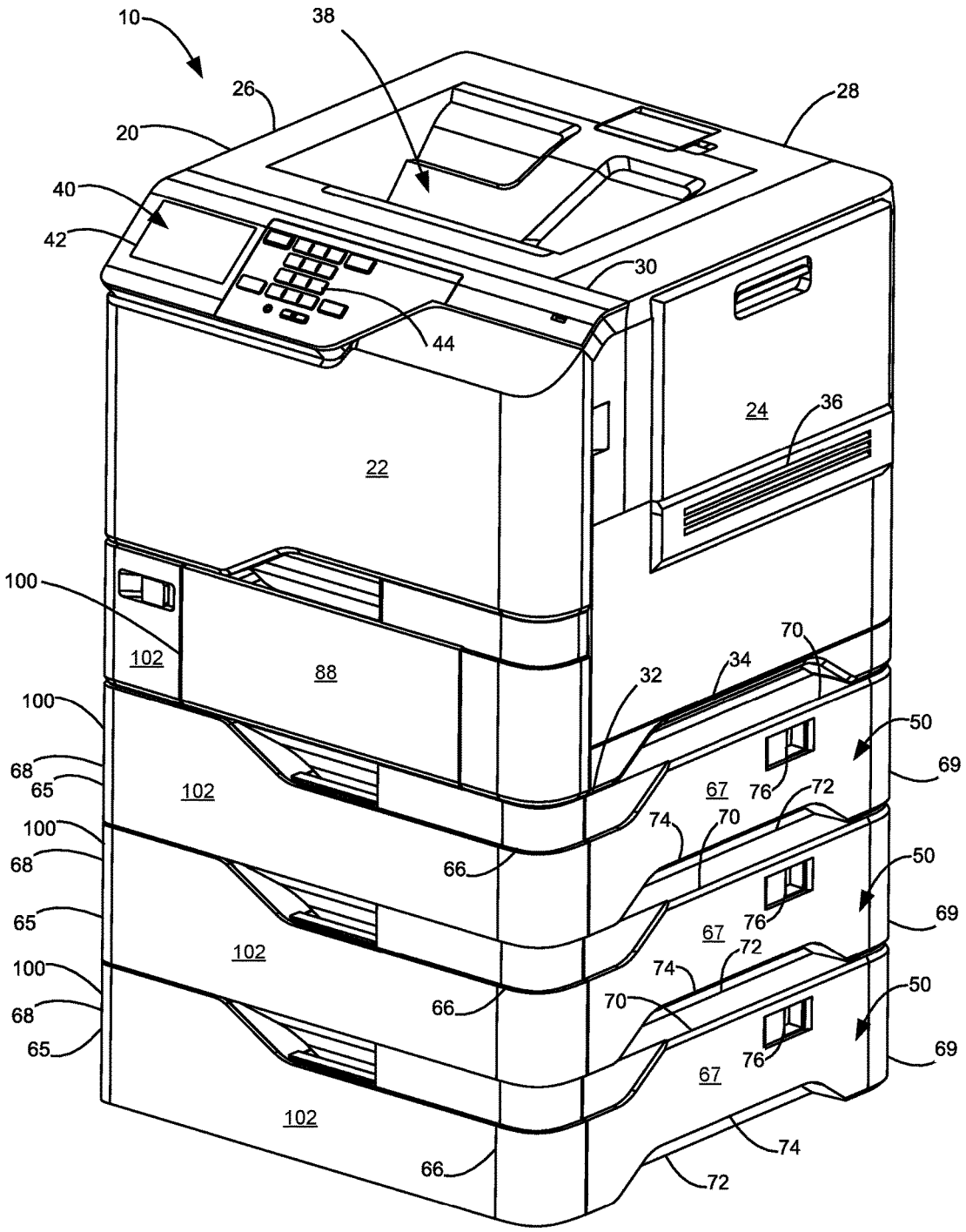
FIG. 1 is an illustration of the imaging device having a removable media tray attached to a stack of option assemblies each of which also have a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "spring seat" or "spring mount" are used interchangeably.

FIG. 1 illustrates an example imaging device 10 atop three example option assemblies 50. Imaging device 10 has a housing 20 having a front 22, a first and second sides 24, 26, a rear 28, a top 30 and a bottom 32 and into which a removable media tray 100 is slidably inserted. Option assembly 50 has a housing 65 having a front 66, a first and second sides 67, 68, a rear 69, a top 70 and a bottom 72 and into which removable media tray 100 is slidably inserted. A user interface 40 comprising a display 42 and a key panel 44 may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 88 folds out from the front of the removable media tray 100 in imaging device 10 and may be used for handling envelopes, index cards or other media where only a small number of the media will be printed. The multipurpose tray 88 may also be incorporated into front 22 of housing 20 rather than being incorporated into removable media tray 100. Hand grips 34, 74 are provided in several locations on housings 20, 65, respectively, such as on sides 24, 26, 67, 68. Also, ventilation openings, such as vents 36 are provided on imaging device 10 such as those shown on first side 24. Latches 76 are provided on each option assembly 50 to secure it to either imaging device 10 or a superior option assembly 50 in the stack.

Option assemblies 50 may be removed or added to the stack. As each option assembly 50 is added, the media path is extended. The option assemblies 50 are stackable allowing one or more option assemblies 50 to be used with a single imaging device 10. An additional option assembly 50 is typically positioned on top of the uppermost option assembly 50 in the stack. Typically, each option assembly 50 may contain a different type of media such as letterhead or a different size such as A4 or a larger quantity of the same media type that is found in the removable media tray 100 integrated into imaging device 10. Each removable media tray 100 is sized to contain a stack of media sheets that will receive color and/or monochrome images. Each removable media tray 100 may be sized to hold the same number of media sheets or may be sized to hold different quantities of media sheets. Example media sizes include but are not limited to A6, 8½"×11", A4, and 11"×17". In some instances, the removable media tray 100 in imaging device 10 may hold a lesser, equal or greater quantity of media than a removable media tray 100 found in an option assembly 50.

Figure 2:
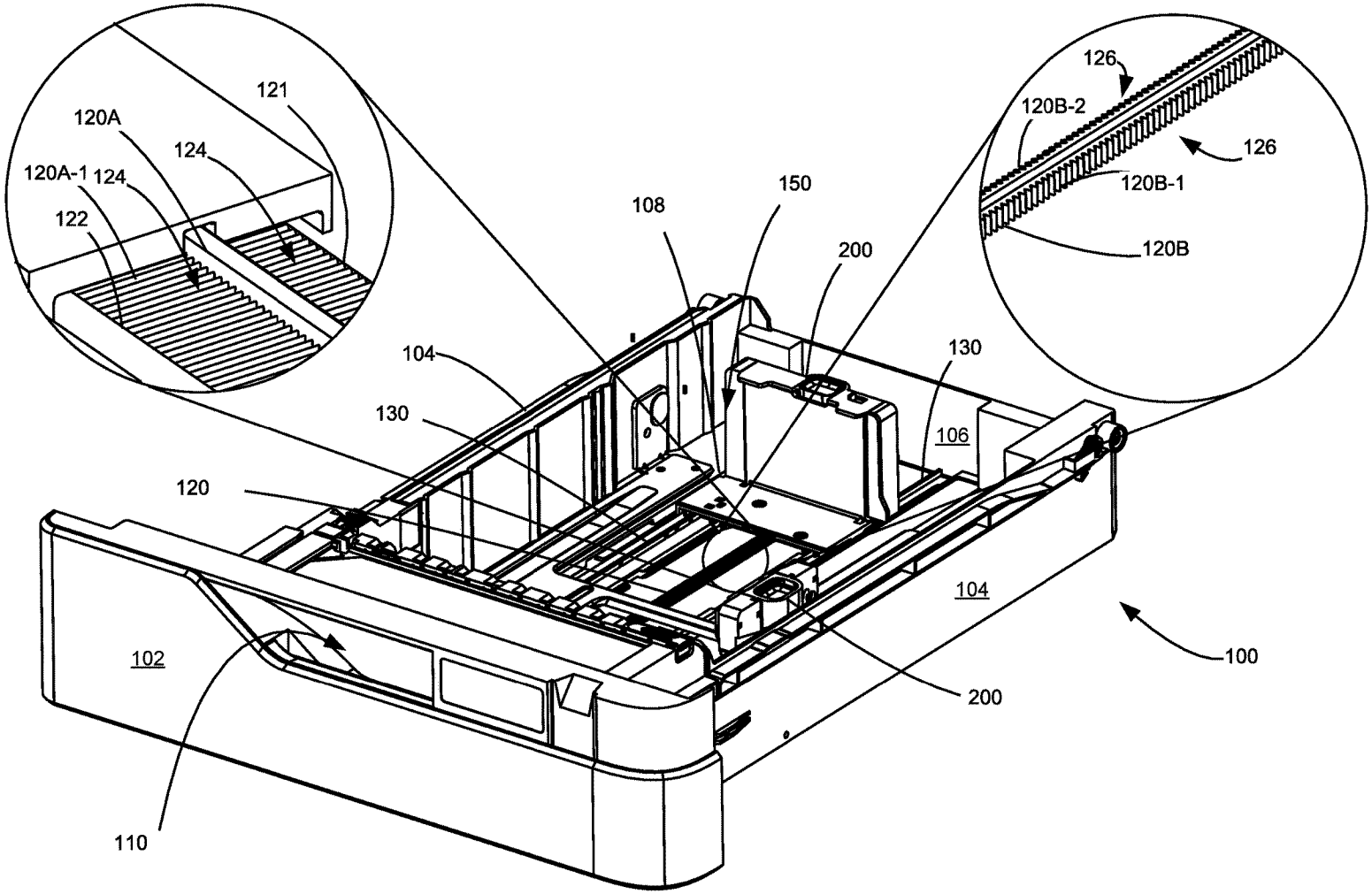
FIG. 2 is a perspective illustration of a removable media tray for the imaging device of FIG. 1 having a rear and side edge media restraint of the present disclosure and two insets showing track configurations useable with a media restraint.

Referring to FIG. 2, removable media tray 100 is shown. Removable media tray 100 is sized to hold approximately 550 pages of 20 pound media which has a media stack height of about 59 mm. Removable media tray 100 has a front wall 102, side walls 104 and a rear wall 106 depending from a bottom 108. Media storage area 150 is generally defined by front wall 102 and side walls 104, and bottom 108. Provided in each removable media tray 100 are one or more adjustable media restraints 200, shown to be placed at a rear and a side edge of the media storage area 150, to accommodate different media widths and lengths. A handle 110 is provided in front wall 102 for removing and inserting removable media tray 100 into imaging device 10 or option assembly 50.

Provided on the bottom 108 of removable media tray 100 is a track 120 on which media restraint 200 travels and latches. The insets in FIG. 2 show two configurations of the track 120. The left inset shows a track 120A having a plurality of horizontal serrations or teeth 124 across the top 120A-1 thereof. Track 120A is also illustrated as having two parallel sections 121, 122 each having a plurality of horizontal serrations 124. The right inset shows a track 120B having a plurality of vertical serrations or teeth 126 along at least one of its sides. As shown, serrations 126 are provided on each of its sides 120B-1, 120B-2. Media restraint 200 engages with the track 120 using a later described latching mechanism that engages with serrations 124 or serrations 126. One or more guide rails 130 may also be provided on the bottom 108 for guiding the media restraint 200 as it is moved between positions along track 120.

Figure 3B:
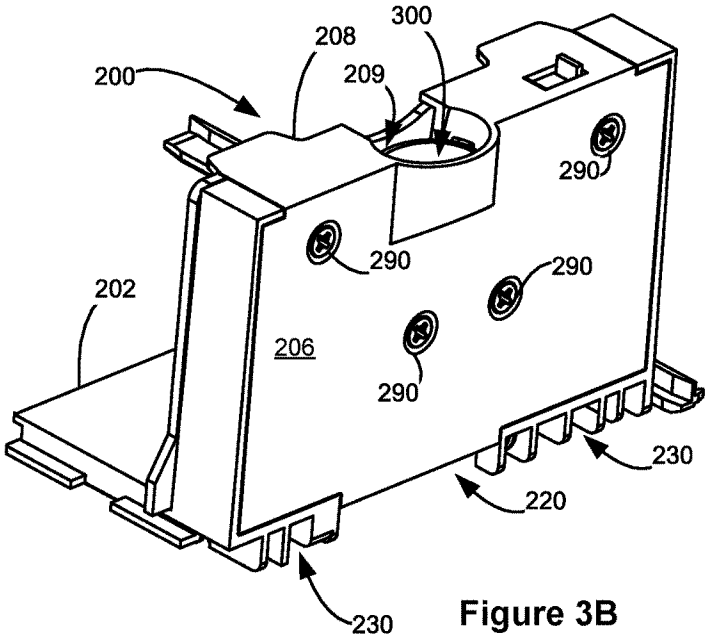
FIGS. 3A-3B are front and rear views of the media restraint of the present disclosure where
Figure 3A:
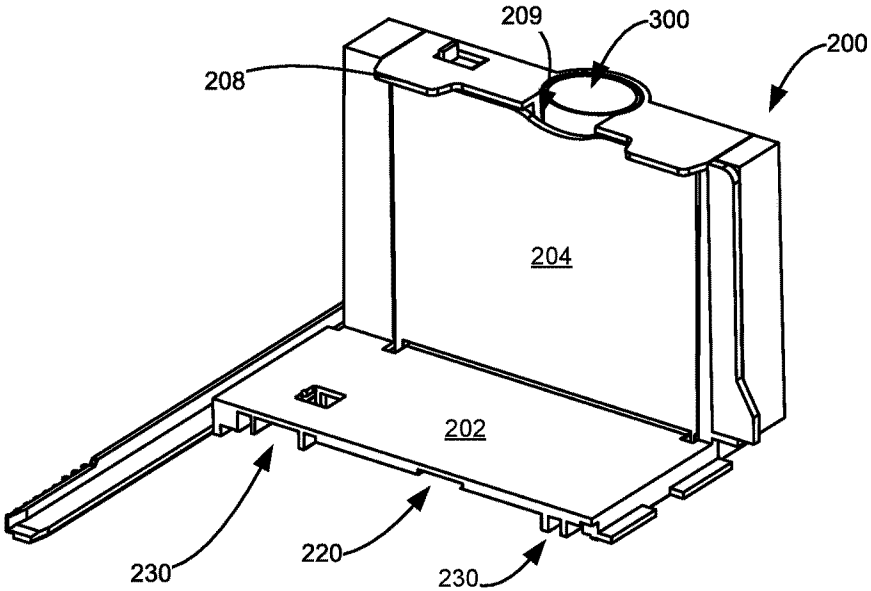

Referring to FIGS. 3A-3B, media restraint 200 has a bottom plate 202 which travels along track 120B and guide rails 130. Channels 220 and 230 are provided in the bottom surface of bottom plate 202 and are sized to receive track 120B and guide rails 130, respectively. Depending from bottom plate 202 are a front plate 204 and a rear plate 206 that are joined by a top plate 208. A support plate 250 is shown attached to the undersurface of bottom plate 202 by fasteners 290. A latching mechanism 300 is mounted between the front and rear plates 204, 206 and is used to engage the media restraint 200 to the track 120B. An opening 209 is provided in top plate 208 to access latching mechanism 300. Top plate 208 may be integrally molded as part of rear plate 206 or as part of front plate 204. Rear plate 206 is attached to front plate 204 by one or more fasteners 290. Four fasteners 290 are shown.

Figure 4B:
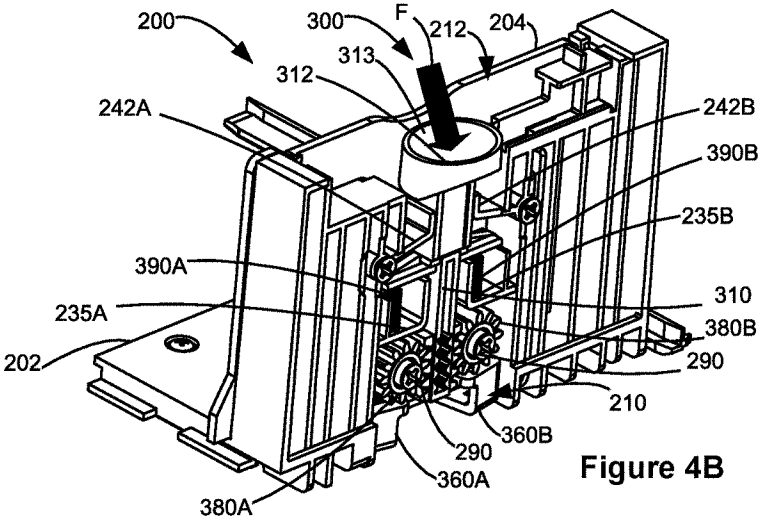
FIGS. 4A-4B are perspective rear views of the media restraint of the present disclosure with a rear plate and a top plate removed where
Figure 4A:
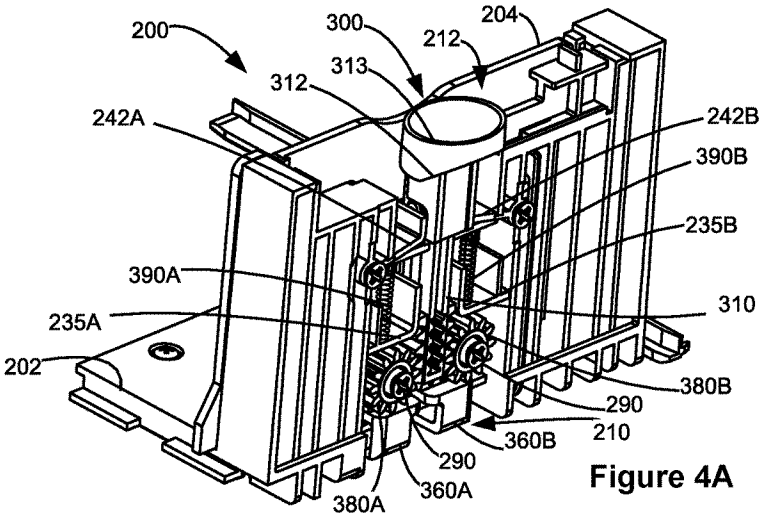

Referring to FIGS. 4A-6B, operation of latching mechanism 300 is shown. Rear and top plates 206, 208 have been removed to show latching mechanism 300. As shown, latching mechanism 300 is positioned within a recess 212 provided in front plate 204. In FIGS. 4A, 5A, and 6A latching mechanism 300 is shown in an engaged position with track 120B while in FIGS. 4B, 5B, and 6B latching mechanism 300 is shown in a disengaged position with respect to track 120B. Latching mechanism 300 includes an actuator 310, a first and a second latching cam 360A, 360B, a first and second pinion gear 380A, 380B and a first and a second biasing member 390A, 390B.

Actuator 310 further includes a button portion 312 on a top end 314 thereof and a first and a second rack 330A, 330B extending from a bottom end 316 thereof toward the button portion 312. Button portion 312 has a concave surface for receiving a fingertip of a user of the media restraint 200. First and second racks 330A, 330B are shown located on outer surfaces 318A, 318B of actuator 310. Depending from outer surfaces 318A, 318B are a first and a second arm 332A, 332B located approximately midway between the top and bottom ends 314, 316. First and second pinion gears 380A, 380B are rotatably fastened to one of front plate 204 or rear plate 206. As illustrated in the referenced figures, the first and second pinion gears 380A, 380B are rotatably attached by fasteners 290 to a lower portion of front plate 204 adjacent to bottom plate 202. Actuator 310 is positioned between the first and second pinion gears 380A, 380B such that first and second racks 330A, 330B are respectively engaged with first and second pinion gears 380A, 380B.

Figure 5B:
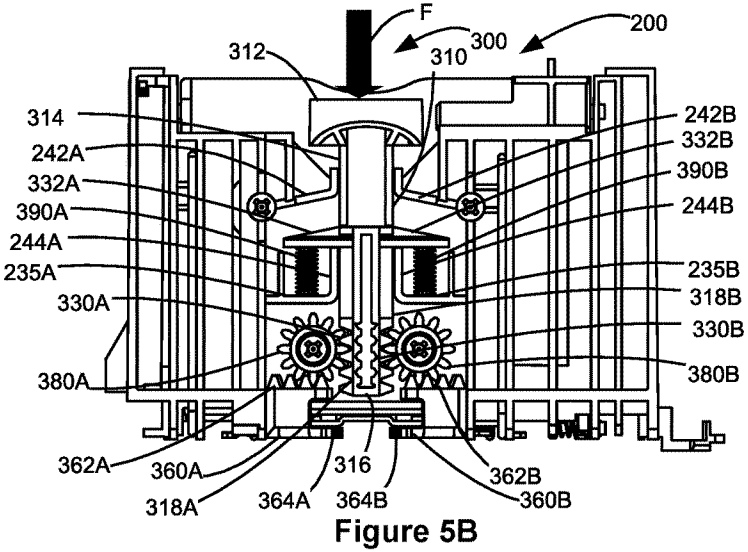
FIGS. 5A-5B are rear views of the media restraint with the rear and top plates removed and corresponding to FIGS. 4A-4B, respectively, where
Figure 5A:
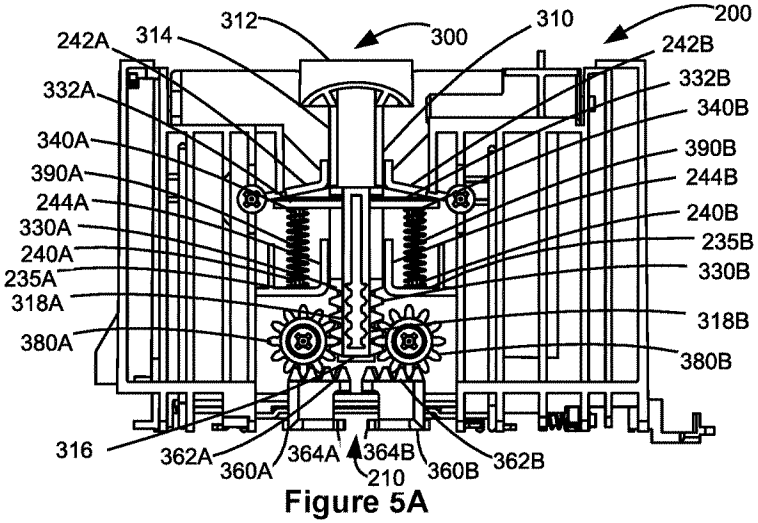

Referring to FIGS. 4A, 5A, first and second spring mounts 235A, 235B depend from front plate 204 and are respectively positioned beneath arms 332A, 332B and above first and second pinion gears 380A, 380B. First and second biasing members 390A, 390B, shown as first and second coil springs 390A, 390B, are respectively positioned between first and second arms 332A, 332B, and first and second spring mounts 235A, 235B. First and second arms 332A, 3332 B may be provided with posts 340A, 340B that are aligned with posts 240A, 240B on first and second spring mounts 235A, 235B which are used for retaining first and second coil springs 390A, 390B within the recess 212 of front plate 204. First and second coil springs 390A, 390B bias the actuator 310 and the first and second latching cams 360A, 360B into their respective first positions where latching cams 360A, 360B are engaged with track 120B. First and second arms 332A, 332B are biased against upper stops 242A, 242B that depend from front plate 204 when actuator 310 is in its first position.

Figure 6A:
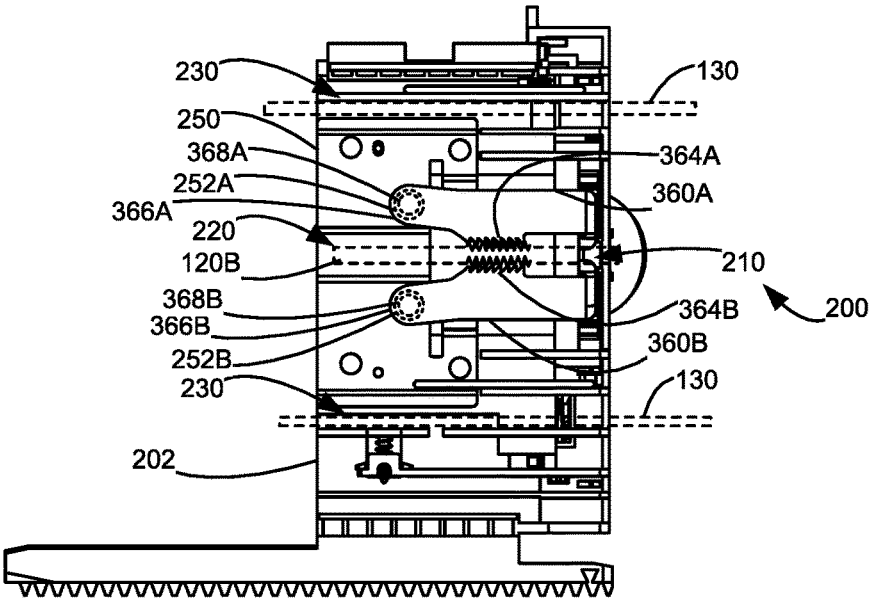
FIGS. 6A-6B are bottom views of the media restraint of the present disclosure where
Figure 6B:
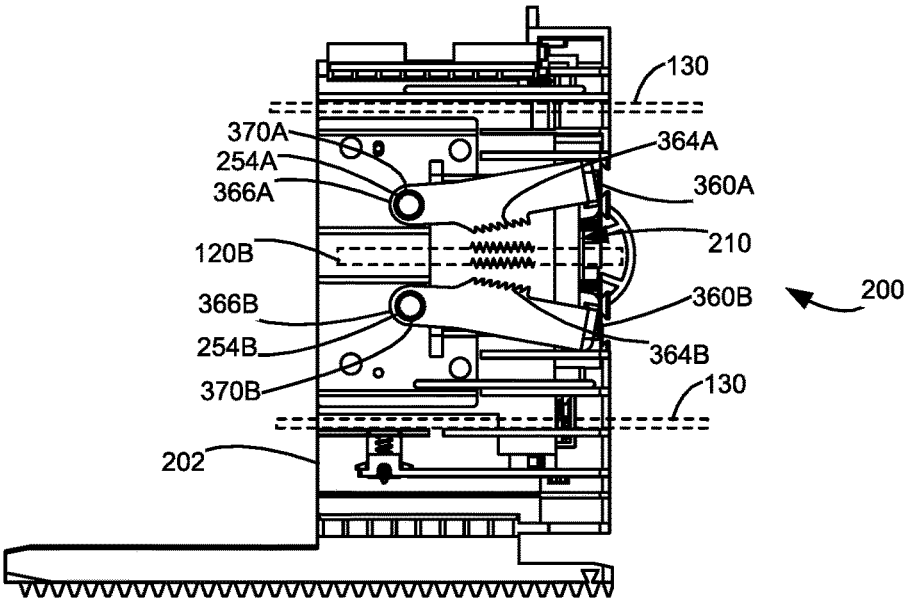

Referring to FIGS. 4A, 5A and 6A, actuator 310 and first and second latching cams 360A, 360B are shown in their respective first positions engaged with track 120B. Track 120B and guide rails 130 are shown in dashed line in FIG. 6A. First and second latching cams 360A, 360B are mirrored about track 120B and have planar serrated portions 364, 364B that engage with vertical serrations 126 on track 120B and rack portions 362A, 362B that engage with first and second pinion gears 380A, 380B, respectively. As shown, first and second latching cams 360A, 360B are L-shaped with rack portions 362A, 362B extending upwardly through opening 210 provided in bottom plate 202 and planar serrated portions 364A, 364B being parallel to bottom plate 202. Rack portions 362A, 362B are translatable within opening 210. The ends 366A, 366B of serrated portions 364A, 364B are shown pivotally attached to support plate 250. Pins 368A, 368B are provided at the ends 366A, 366B, respectively, of planar serrated portions 364A, 364B and are received into corresponding openings 252A, 252B in support plate 250 or directly into openings 214A, 214B provided in bottom plate 202 (see FIG. 3A) should support plate 250 not be used. Alternatively, as shown in FIG. 6B, openings 370A, 370B, may be provided in ends 366A, 366B that receive pins 254A, 254B, provided on support plate 250. The manner of attachments of the ends 366A, 366B are illustrative only and should not be considered as limiting.

Referring to FIGS. 4B, 5B and 6B, actuator 310 and first and second latching cams 360A, 360B are shown in their respective second positions disengaged from track 120B. Track 120B and guide rails 130 are shown in dashed line in FIGS. 6A and 6B. Upon application of a user-supplied downwardly-directly force F, indicated by the black arrow in FIG. 5B, to button portion 312, actuator 310 is downwardly translated from its first position compressing first and second coil springs 390A, 390B with racks 330A, 330B rotating first and second pinion gears 380A, 380B, respectively, that in turn translates and separates first and second latching cams 360A, 360B, moving them from their first positions due to the translation of rack portions 362A, 362B of the first and second latching cams 360A, 360B, respectively. This translation causes planar serrated portions 364A, 364B to pivotally disengage from track 120B without the use of a pinching force, allowing media restraint 200 to be repositioned along track 120B. First and second lower stops 244A, 244B may be provided on front plate 204 below first and second upper stops 242A, 242B to limit downward travel of actuator 310 and provide tactile feedback to the user that media restraint 200 has been disengaged from track 120B. Upon removal of the user-supplied downward force F, biasing members 390A, 390B return actuator 310 and first and second latching cams 360A, 360B to their respective first positions. By applying the downward force F at an angle with respect to vertical in the desired direction of movement, as shown in FIG. 4B, the user is able to move the media restraint along the track 120B with their finger without pinching the media restraint 200.

Figure 7:
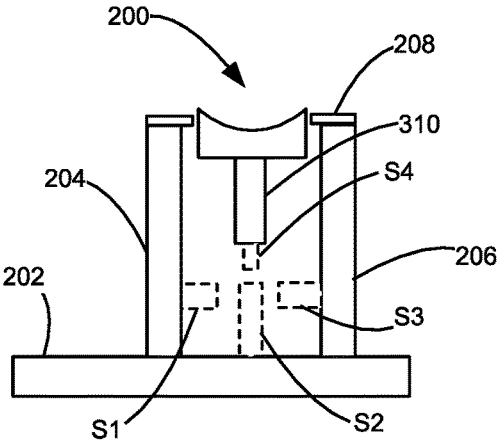
FIG. 7 is a schematic illustration of various mounting locations for stops used in the media restraint of the present disclosure.
Figure 8:
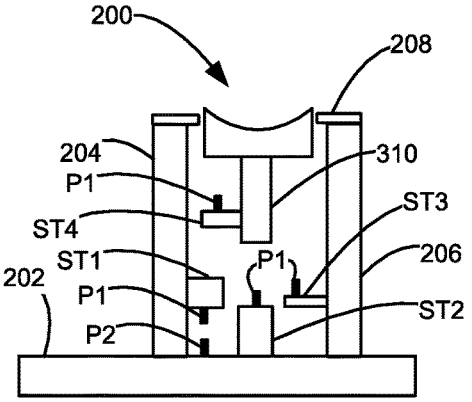
FIG. 8 is a schematic illustration of various mounting locations for spring seats used in the media restraint of the present disclosure.
Figure 9:
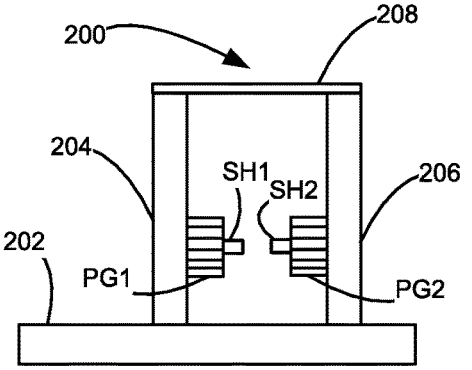
FIG. 9 is a schematic illustration of various mounting locations for pinion gears used in the media restraint of the present disclosure.

Referring now to FIGS. 7-9, various mounting arrangements for stops, spring mounts or seats and the pinion gears are schematically illustrated. In FIG. 7, stops S1, S2, S3 are shown mounted on the front plate 204, bottom plate 202, and rear plate 206, respectively. Stop S4 is shown depending from the bottom of actuator 310. Spring mounts or seats ST1-ST4 are used for seating biasing members in media restraint 200, 200-1. In FIG. 8, spring seats ST1, ST2, ST3 are shown mounted on the front plate 204, bottom plate 202, and rear plate 206, respectively. Spring seat ST4 is shown depending from the actuator 310. Post P1 may be provided on seats ST1-ST4. Post P2 is shown depending from bottom plate 202. Posts P1, P2 may be used to hold biasing members on their spring seats. In FIG. 9, pinion gears PG1, PG2 are shown mounted on shafts SH1, SH2 on the front and rear plates 204, 206, respectively. The number and location of the stops, spring seats, posts and shafts are a matter of design choice and the locations shown in the figures are for the purpose of illustration and not limitation and similarly for the number and mounting of the pinion gears and the number and mounting of the biasing members.

For the disclosed embodiments of the media restraint, front plate 204 is shown having the recess 212 into which the latching mechanism 300 is mounted. As would be understood by one of ordinary skill in the art, the latching mechanism 300 may be mounted to the rear plate 206 or some components may be mounted to the front plate 204 and others to the rear plate 206. The mounting arrangement for the latching mechanism 300 is a matter of design choice and the configurations shown should not be taken as limiting. For media restraint 200, the mounting of bottom plate 202, front plate 204, rear plate 206, and top plate 208 to one another is a matter of design choice, and the configuration shown should not be viewed as limiting.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media tray for an imaging device, the removable media tray comprising:

a bottom surface for holding media to be fed to the imaging device;

a track having a plurality of serrations along a length thereof, the track positioned on the bottom surface; and, a media restraint slidably engageable with the track, the media restraint including:

a bottom plate having a first opening therethrough;

a front plate and a rear plate spaced from the front plate, the front and rear plates depending from the bottom plate;

a top plate extending between the front and rear plate having a second opening therethrough; and, a latching mechanism received between the front, rear and top plates, the latching mechanism including:

a first and a second pinion gear, the first and second pinion gears rotatably attached to one of the front and rear plates at a predetermined distance from the bottom plate;

an actuator slidably received between the front and rear plates and having a first position adjacent the top plate, the actuator having a button depending from an upper end thereof and aligned with the second opening, the actuator further having a first and a second rack portion engaged with the first and second pinion gears, respectively;

a first and a second latching cam each having a serrated portion for engaging with the track and a rack portion engaging with the first and second pinion gears, respectively, the serrated portions each having an end thereof pivotally mounted to the bottom plate, the first and second latching cams having respective first positions being engaged with the track when the actuator is in its first position;

and, a biasing member for biasing the actuator and the first and the second latching cams in their respective first positions;

wherein, upon application of a user-supplied downwardly directed force to the button, the actuator moves from its first position and translates downwardly with the first and second rack portions rotating the first and second pinion gears, respectively, which horizontally separates and translates the first and second latching cams away from their respective first positions and pivots the serrated portions thereof away from the track allowing the media restraint to be translated along the track, and, further wherein, when the downwardly directed force is removed, the biasing member returns the actuator and the first and second latching cams to their respective first positions.

2. The removable media tray of claim 1, wherein the plurality of serrations of the track further comprise a first plurality of serrations along a first side of the track and a second plurality of serrations along a second side of the track.

3. The removable media tray of claim 2, wherein the first and second latching cams are respectively engaged with the first and second sides of the track when in their respective first positions.

4. The removable media tray of claim 1, further comprising:

a first and a second seat depending from the front plate, the first and second seats spaced apart allowing the actuator to slide therebetween;

the actuator having a first and a second arm depending therefrom, the first and second arm positioned adjacent to the upper end of the actuator; and, the biasing member including a first and a second spring mounted between the first seat and first arm and the second seat and second arm, respectively.

5. The removable media tray of claim 1, wherein the button has a concave surface for receiving and holding a fingertip of a user.

6. The removable media tray of claim 1, wherein the bottom plate has a channel therein aligned with and sized to receive a second track that is parallel to the track in the removable media tray.

7. A removable media tray for an imaging device, the removable media tray comprising:

a bottom surface for holding media to be fed to the imaging device;

a track having a plurality of teeth along a length thereof, the track positioned on the bottom surface; and, a media restraint slidably engageable with the track, the media restraint including:

a bottom plate having a first opening therethrough;

a front plate depending from the bottom plate, the front plate having a recess therein sized to receive a latching mechanism, the recess having a bottom open to the first opening in the bottom plate and a top opening;

a rear plate for substantially enclosing the recess;

one or more fasteners for attaching the rear plate to the front plate;

and, the latching mechanism including:

a first and a second pinion gear, the first and second pinion gears rotatably attached to the front plate at a predetermined distance from the bottom plate;

an actuator slidably received in the recess and having a first position adjacent the top of the front plate, the actuator having a button depending from an upper end thereof and aligned with the top opening of the recess, the actuator further having a first and a second rack portion engaged with the first and second pinion gears, respectively;

a first and a second latching cam, the first and the second latching cams each having a serrated portion for engaging with the track and a rack portion engaging with the first and second pinion gears, respectively, the serrated portions each having an end thereof pivotally mounted to the bottom plate, the first and second latching cams having respective first positions being engaged with the track when the actuator is in its first position;

and, a biasing member for biasing the actuator and the first and the second latching cams in their respective first positions;

wherein, upon application of a user-supplied downwardly directed force to the button, the actuator moves from its first position and translates downwardly with the first and second rack portions rotating the first and second pinion gears, respectively, which separates and horizontally translates the first and second latching cams away from their respective first positions and pivots the serrated portions thereof away from the track allowing the media restraint to be translated along the track, and, further wherein, when the downwardly directed force is removed, the biasing member returns the actuator and the first and second latching cams to their respective first positions.

8. The removable media tray of claim 7, wherein the plurality of teeth of the track further comprise a first plurality of serrations along a first side of the track and a second plurality of serrations along a second side of the track.

9. The removable media tray of claim 8, wherein the serrated portions of the first and the second latching cams are respectively engaged with the first and the second sides of the track when in their respective first positions.

10. The removable media tray of claim 8, wherein the bottom plate has a support plate detachably fasten to a bottom surface thereof and the ends of the serrated portions are pivotally attached to the support plate.

11. The removable media tray of claim 7, further comprising:

a first and a second seat depending from the front plate, the first and second seats spaced apart allowing the actuator to slide therebetween;

the actuator having a first and a second arm depending therefrom, the first and second arm positioned adjacent to the upper end of the actuator; and, the biasing member including a first and a second spring mounted between the first seat and first arm and the second seat and second arm, respectively.

12. The removable media tray of claim 7, wherein the button has a concave surface for receiving and holding a fingertip of a user.

13. The removable media tray of claim 7, wherein the bottom plate has a channel therein aligned with and sized to receive a second track that is parallel to the track in the media tray.

14. A media restraint slidably mountable on a track in a removable media tray for an imaging device, the media restraint comprising:

a bottom plate having a first opening therethrough;

a front plate and a rear plate each depending from the bottom plate;

a top plate extending between the front and rear plate having a second opening therethrough; and, a latching mechanism including:

a first and a second pinion gear, the first and second pinion gears rotatably attached to one of the front and rear plates at a predetermined distance from the bottom plate;

an actuator slidably received between the front and rear plates and having a first position adjacent the top plate, the actuator having a button depending from an upper end thereof and received in the second opening, the actuator further having a first and a second rack portion engaged with the first and second pinion gears, respectively;

a first and a second latching cam, the first and the second latching cams each having a serrated portion horizontally disposed and parallel to respective sides of the track and a vertically disposed rack portion engaging with the first and second pinion gears, respectively, the serrated portions having an end thereof pivotally mounted to the bottom plate, and, when the media restraint is installed in the removable media tray, the first and second latching cams having respective first positions wherein the serrated portions are engaged with the track when the actuator is in its first position;

and, a biasing member mounted for biasing the actuator and the first and second latching cams in their respective first positions;

wherein, when the media restraint is installed in the removable media tray, upon application of a user-supplied downwardly directed force to the button, the actuator moves from its first position wherein the serrated portions are engaged with the track and translates downwardly with the first and second rack portions rotating the first and second pinion gears, respectively, which horizontally translates the first and second latching cams away from their respective first positions and pivots the serrated portions away from the track allowing the media restraint to be translated along the track, and, further wherein, when the downwardly directed force is removed, the biasing member returns the actuator and the first and second latching cams to their respective first positions.

15. The media restraint of claim 14, wherein the track further comprises a first plurality of serrations along a first side of the track and a second plurality of serrations along a second side of the track and the first and second latching cams are respectively engaged with the first and second sides of the track when in their respective first positions.

16. The media restraint of claim 14, further comprising:

a first and a second seat depending from the front plate, the first and second seats spaced apart allowing the actuator to slide therebetween;

the actuator having a first and a second arm depending therefrom, the first and second arm positioned adjacent the upper end of the actuator; and, the biasing member including a first and a second spring mounted between the first seat and first arm and the second seat and second arm, respectively.

17. The media restraint of claim 14, wherein the button has a concave surface for receiving and holding a fingertip of a user.

18. The media restraint of claim 14, wherein the bottom plate has a channel therein aligned with and sized to receive a second track that is parallel to the track in the removable media tray.

19. The media restraint of claim 14, wherein the bottom plate has a support plate detachably fastened to a bottom surface thereof, and, the respective ends of the serrated portions are pivotally attached to the support plate.

* * * * *